US007789123B2

(12) United States Patent
Hohenbichler et al.

(10) Patent No.: US 7,789,123 B2
(45) Date of Patent: Sep. 7, 2010

(54) SEQUENCE CASTING PROCESS FOR PRODUCING A HIGH-PURITY CAST METAL STRAND

(75) Inventors: Gerald Hohenbichler, Kronstorf (AT); Gerald Eckerstorfer, Linz (AT); Markus Brummayer, Aschach (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 359 days.

(21) Appl. No.: 10/581,385

(22) PCT Filed: Nov. 10, 2004

(86) PCT No.: PCT/EP2004/012711

§ 371 (c)(1),
(2), (4) Date: Aug. 16, 2006

(87) PCT Pub. No.: WO2005/053877

PCT Pub. Date: Jun. 16, 2005

(65) Prior Publication Data

US 2008/0173423 A1 Jul. 24, 2008

(30) Foreign Application Priority Data

Dec. 2, 2003 (AT) ..... A 1927/2003

(51) Int. Cl.
*B22D 11/18* (2006.01)

(52) U.S. Cl. ..... 164/453; 164/490

(58) Field of Classification Search ..... 164/453, 164/488–490; 222/590–591, 594
See application file for complete search history.

(56) References Cited

U.S. PATENT DOCUMENTS 4,098,321 A * 7/1978 Wilson et al. ..... 164/434

(Continued)

FOREIGN PATENT DOCUMENTS

EP 0 887 129 A1 12/1998

(Continued)

OTHER PUBLICATIONS

International Search Report PCT/EP2004/012711 dated Aug. 26, 2005.

(Continued)

*Primary Examiner*—Jessica L Ward
*Assistant Examiner*—Nicholas P D'Aniello
(74) *Attorney, Agent, or Firm*—Ostrolenk Faber LLP

(57) ABSTRACT

The invention relates to a sequence casting process for producing a high-purity cast metal strand from a metal melt, the metal melt being fed in controlled fashion from a metal vessel to a tundish and being discharged in controlled fashion from this tundish into a continuous-casting mold, and the supply of the metal melt into the continuous-casting mold being continued without interruption. To allow a high-quality metal strand to be cast even during the change of melt vessel in this process, with the restart phase being kept as short as possible, it is proposed that during a period of time from the resumption of the supply of metal melt into the tundish until the point at which a quasi-steady operating bath level in the tundish is reached, the inflow rate into the tundish is greater than the outflow rate out of the tundish, and for 70% to 100% of this period the inflow rate into the tundish is less than or equal to double the outflow rate out of the tundish.

25 Claims, 6 Drawing Sheets

U.S. PATENT DOCUMENTS

| | | | | |
|---|---|---|---|---|
| 5,887,647 | A | 3/1999 | Melville et al. | 164/472 |
| 2005/0067134 | A1 | 3/2005 | Brummayer et al. | 164/473 |

FOREIGN PATENT DOCUMENTS

| | | | |
|---|---|---|---|
| JP | 60133957 | A | 7/1985 |
| WO | WO 03/051560 | A2 | 6/2003 |

OTHER PUBLICATIONS

R. Bölling et al., "Nonstationary Casting Phases in Continuous Casting Tundishes—Use of the VoF Model for Analusis of the Ladle Change", FLUENT User Conference, Frankenthal, Sep. 25-26, 2002, Institut für Industrieofenbau und Wärmetechnik im Hüttenwesen, RWTH Aache, Kopernikusstr. 16, 52074 Aachen, pp. 10-15.

* cited by examiner

SEQUENCE CASTING PROCESS FOR PRODUCING A HIGH-PURITY CAST METAL STRAND

CROSS REFERENCE TO RELATED APPLICATIONS

The present application is a 35 U.S.C. §371 National Phase conversion of PCT/EP2004/012711 filed Nov. 10, 2004, which claims priority of Austrian Patent Application No. A 1927/2003 filed Dec. 2, 2003 which is herein incorporated by reference. The PCT International Application was published in the German language.

BACKGROUND OF THE INVENTION

The invention relates to a sequence casting process for the continuous production of a high-purity cast metal strand from a metal melt, preferably a steel melt, the metal melt being fed in controlled fashion from a melt vessel to a tundish and being discharged in controlled fashion from this tundish into a continuous-casting mold, and the supply of metal melt into the tundish being interrupted during the change of melt vessel, whereas the supply of the metal melt into the continuous casting mold is continued.

A sequence casting process is to be understood as meaning a casting process in which a plurality of metal batches, which are supplied to the casting installation in a plurality of melt vessels, are continuously cast to form a single metal strand without interruption to the casting process. It is in this case necessary for the melt vessel, after it has been emptied, to be exchanged for a further, full melt vessel within the shortest possible time. There is inevitably an interruption to the inflow of melt into the tundish, and it is necessary for the residual quantity in the tundish to be such that a sufficient quantity of residual metal melt is held in the tundish to span the changeover time which is needed before metal melt can flow into the tundish again from the further melt vessel which has been moved into the casting position. To maintain the continuous casting process during the changeover time, it is customary for the casting rate of the casting installation to be reduced during the changeover time. The changeover time can be kept very short using a ladle turning tower.

The continuous-casting installation itself can be equipped with a permanent mold of any desired design, such as for example one or more oscillating plate or tube molds, with caterpillar molds, with molds comprising rotating belts or molds which are formed by rotating casting rollers with insulating side walls. The cross-sectional format of the metal strand that is to be cast can also be set as desired, but especially when producing thin metal strips with thicknesses of less than 6.0 mm and widths of over 800 mm, particularly high demands are imposed on the starting phase or restart phase of the casting process after a ladle change, since in particular on account of the relatively small melt pool and the practically invariable metallurgical length until the kissing point in a two-roller casting installation, as well as the rapid full solidification of a thin metal strand, it is not possible to significantly reduce the casting rate. Furthermore, it is necessary to take into account the fact that during resumption of the supply of melt into the tundish, increased bath movement occurs in the residual metal melt, which is already covered with covering agent, and on account of the increased formation of waves at the bath surface, increased amounts of covering agent are introduced into the metal bath. Furthermore, when the ladle slide is opened, filling sand is introduced into the tundish, which requires a certain time and a calmer metal bath before it can float to the surface of the bath. The invention relates in particular to the casting of a metal strip using a two-roller casting installation based on the vertical two-roller casting process.

During production of a high-purity cast metal strand using any desired continuous casting installation, the liquid metal is usually fed from a casting ladle via at least one tundish or transfer vessel to a cooled permanent mold, in which the metal melt solidification process to form a metal strand is at least initiated. The transfer of the metal melt from the casting ladle into the tundish and from the latter into the permanent mold predominantly takes place through immersion pipes or shrouds, which, during steady-state casting operation are immersed in the melt pool of the vessel in each case arranged downstream and thereby allow flow and transfer of the metal melt into the permanent mold to be as calm and uniform as possible. The metal melt which has accumulated in the casting ladle, the tundish and, if appropriate in the permanent mold is usually covered by a layer of slag which protects the metal bath surface from oxidation. The basic arrangement of the melt-holding vessels in a multi-strand continuous casting installation for steel is known, for example, from U.S. Pat. No. 5,887,647. The more intensive the metal bath movement in the individual melt vessels, the more slag particles are introduced into the metal bath from the slag layer covering the metal melt, and the more particles of the refractory material from the lining of the melt vessels are also fed to the metal bath as a result of erosion. At the same time, the separation of particles of foreign material out of the metal melt at the metal bath surface or into the slag layer is impeded by excessively intensive metal bath movement. In the case of large-format metal strands, such as strands with slab cross sections, time for separating off foreign substances at the bath surface also remains in the permanent mold. In the case of small-format strands, and in particular strips with a low thickness, the introduction of foreign particles into the permanent mold should be avoided as far as possible, since the extent to which foreign particles can be separated off tends to be much more restricted in the permanent mold.

It is generally known that the quality of the cast strand is reduced if considerable fluctuations in bath level occur, as are inevitable during the starting phase of the casting process during initial filling of the tundish or as occur during a ladle change in sequence casting, wherein the metal melt which is held in the tundish is usually employed to span the ladle changeover time, and therefore casting is carried out with a continuously decreasing bath level. The stability of the melt flow in the tundish is greatly impaired as a result, and the metal melt is subject to undesirable introduction of slag.

SUMMARY OF THE INVENTION

Therefore, it is an object of the invention to avoid these drawbacks and difficulties of the known prior art and to propose a sequence casting process of the type described in the introduction, by which even during the melt vessel changeover, increased introduction of foreign particles into the metal melt is minimized, and therefore in the continuous-casting mold a similar or increased introduction of foreign particles into the solidification product is likewise minimized, and immediately on resumption of the quasi-steady casting phase a high-purity metal strand can be cast, and in which, furthermore, this phase spanning the melt vessel changeover time in the continuous casting process can be kept as short as possible, and in which at least any effects derived from non-steady-state casting phases, such as the melt vessel changeover, decay as quickly as possible.

According to the invention, this object is achieved by virtue of the fact that during a period of time from the resumption of the supply of metal melt into the tundish until the point at which a quasi-steady operating bath level in the tundish is reached, the inflow rate into the tundish is greater than the outflow rate out of the tundish, and for 70% to 100%, preferably for 70% to 99%, in particular for 70% to 95%, of this period the inflow rate into the tundish is less than or equal to double, preferably less than or equal to 1.5 times, the outflow rate out of the tundish.

The minimum inflow rate into the tundish during this period is to a very significant extent dependent on the reduction in the casting rate on the continuous-casting installation during the melt vessel changeover. However, during this period the inflow rate into the tundish should correspond to at least 0.5 times the maximum inflow rate during steady-state casting operation.

In the present context, the term "tundish" is not restricted just to the holding vessel for metal melt which allows metal melt to be transferred or passed into a permanent mold, i.e. is arranged immediately upstream of a permanent mold, but rather may also encompass all melt vessels between the casting ladle and the mold.

A further improvement to the quality of the cast strand from resumption of the casting process is achieved if the supply of metal melt within the last 5% to 30% of the period from the resumption of the supply of metal melt into the tundish until the point at which the quasi-steady operating bath level is reached takes place at an inflow rate which is reduced compared to the inflow rate during the preceding period of time.

The resumption phase of the casting process is shortened and the most reliable opening of the melt vessel without an adverse effect on the quality of the cast product is achieved if the supply of metal melt takes place at a substantially maximum inflow rate immediately on resumption of the supply of melt into the tundish for 0.1% to 30%, preferably for 3% to 15%, of the period until the point at which the quasi-steady operating bath level in the tundish is reached, and thereafter the supply of metal melt takes place at a filling rate which is reduced compared to the initial filling rate, until the point at which the quasi-steady operating bath level is reached.

The term "maximum filling rate" is to be understood as meaning that the supply of the metal melt into the tundish takes place at the maximum opening of the ladle slide, i.e. at the maximum possible filling rate. This also prevents the ladle slide opening from freezing up during the initial casting phase or a significant narrowing of the through-flow opening and therefore an undesirable reduction in the quantitative flow.

The reduced filling rate does not necessarily represent a constant value throughout the remaining filling time until the point at which the quasi-steady operating bath level is reached, but rather tends to follow a time curve which decreases continuously or in steps, with the result that the flow conditions in the tundish are already being continuously calmed during the filling time.

To calm the metal melt in the tundish, it may be expedient if the supply of metal melt into the tundish is interrupted for a certain period of time when the quasi-steady operating bath level is reached. Closing the ladle slide after the point at which the quasi-steady operating bath level has been reached has the advantage that foreign inclusions which are present, in particular, nonmetallic inclusions, quickly float to the surface of the bath and can be separated out into the covering slag. The brief interruption to the supply of melt represents a good way of increasing the quality of the cast product if it is at the same time ensured that opening of the ladle slide is reliably guaranteed after this calming and separation phase. The period of time for which the supply of melt is interrupted lasts between 1 sec and 2 min, preferably between 10 sec and 70 sec, since the bath level immediately begins to drop again as a result of the metal flowing out into the continuous-casting mold.

To avoid reoxidation at the metal bath surface, it is usual for a covering agent to be applied to the melt bath as soon as the first casting sequence begins. This covering agent is retained over all the casting sequences in the tundish. To ensure that the covering agent near the shroud which is immersed in the metal melt is not—even only partially—drawn into the metal melt along the outer wall of the shroud, it is expedient if a region of the free bath surface in the tundish which immediately surrounds the shroud is kept free of or shielded from coverage with a covering agent at least during quasi-steady-state operation, and preferably all the time. This is effected by shielding means which are formed by wall elements which are either immersed in the melt bath from above or project out of the melt bath from below and surround the shroud at a distance. This deliberately generates a hot spot around the shroud, and it is expedient if the wall elements form a closed chamber, in which the shroud is integrated and the atmosphere enclosed in the chamber is inerted.

It is important for the shielding means to be sufficiently far immersed in the melt bath for them still to be immersed in the tundish even at the minimum bath level during a ladle change just before resumption of the supply of melt. In this way, the slag-free zone around the shroud is maintained even during this operating phase, and the supply of metal melt with little turbulence in the metal bath below the bath surface is ensured.

If the supply of metal melt is briefly interrupted again after the point at which the quasi-steady operating bath level in the tundish has been reached, in order for the bath movement to be additionally calmed and to increase the separation rate of foreign particles, after the resumption of the supply of metal melt into the tundish, this supply of metal melt into the tundish is controlled quantitatively as a function of the discharge of the metal melt from the tundish. In terms of time, the transfer of the metal melt from the tundish into the downstream permanent mold begins with the resumption of the supply of metal melt into the tundish. The control keeps the quasi-steady operating bath level or the corresponding tundish weight at a substantially constant level.

If there is no interruption to the supply of melt into the tundish after the point at which the quasi-steady operating bath level is reached, the supply of metal melt into the tundish is controlled quantitatively as a function of the discharge of the metal melt from the tundish at least for 70% to 100%, preferably for 70% to 99%, in particular for 70% to 95%, of the period from the resumption of the supply of metal melt into the tundish until the point at which a quasi-steady operating bath level is reached in the tundish and/or from the point at which the quasi-steady casting level is reached. This control is based on measuring the current bath level or the current tundish weight.

The quantity of metal melt supplied to the tundish and the quantity of metal melt discharged from the tundish, during casting of a steel strip with a cast thickness of 1.0-5.0 mm and a cast width of 1.0 m to 2.0 m is between 0.5 t/min and 4.0 t/min, preferably between 0.8 t/min and 2.0 t/min. These details are based on the use of a two-roller casting machine with the desired cast product of corresponding design.

In exceptional circumstances, it may be necessary to top up covering agent in the tundish. It is preferable for the addition of the covering agent onto the bath surface of the metal melt in the tundish to take place in a surface region with a low surface flow velocity, waviness of the bath surface and turbulence intensity.

If appropriate, a manual addition of the covering agent requires sufficient accessibility of the tundish for the operating staff and additionally brings with it the drawback of addition inclusions of slag resulting from the sudden local addition of a greater quantity of the covering agent. Therefore, the covering agent is applied in fine-grain or powder form, preferably using a semi-automatic or fully automatic addition device.

The interior of the tundish is shielded from the free atmosphere by a tundish lid, in which context it is expedient for the tundish to be inerted during or before the initial filling phase, in order to substantially reduce the reactive oxygen in the interior of the tundish.

It is preferable for the setting and monitoring of the operating casting level to be effected by means of a tundish weight measurement by using an equivalent measurement method. The operating bath level can also be determined using other direct or indirect measurement methods, such as, for example using floats, optical observation of the bath level surface, ultrasound distance measurement, eddy current measurement and similar measurement methods.

During sequence casting, the bath level in the tundish decreases continuously during the melt vessel changeover, but must not drop below a minimum bath level, which is dependent to a very significant extent on the shape of the tundish and therefore cannot be specified at a general level. An excessive drop in the bath level, in particular during the resumption phase of the melt supply, and especially at maximum filling rate, leads to increased introduction of foreign particles into the metal melt, and these particles spread out throughout the entire tundish. To eliminate or at least substantially attenuate this effect, it is expedient if at least during the period between the resumption of the supply of the metal melt into the tundish and the point at which the quasi-steady operating bath level is reached, the metal melt contained in the tundish is divided by a divider plate into two partial quantities, metal melt from the melt vessel being fed to a first partial quantity and metal melt being discharged from a second partial quantity into the continuous-casting mold, and metal melt being transferred continuously from the first partial quantity to the second partial quantity, the inflow rate to the first partial quantity in the tundish being greater than the outflow rate from the second partial quantity, and the inflow rate to the first partial quantity being less than or equal to double the outflow rate from the second partial quantity for 70% to 100%, preferably for 70% to 99%, in particular for 70% to 95%, of the period from the resumption of the supply of metal melt into the tundish until the point at which the quasi-steady operating bath level of the second partial quantity in the tundish is reached. The spatial division of the tundish accordingly creates two regions, namely a first region, in which from time to time, considerable turbulence may occur and also substantially decays there, and a second region, which remains substantially isolated from these phenomena.

The positive effects of the spatial separation in the tundish are additionally boosted if the supply of metal melt within the last 5% to 30% of the period from the resumption of the supply of metal melt into the tundish until the point at which the quasi-steady operating bath level of the second partial quantity in the tundish is reached takes place at an inflow rate which is reduced compared to the inflow rate during the preceding period of time.

In this case, the filling time required to reach the quasi-steady operating bath level can be shortened if the supply of metal melt takes place at a substantially maximum inflow rate immediately on resumption of the supply of melt into the tundish for 1% to 30%, preferably for 3% to 15%, of the period until the point at which the quasi-steady operating bath level of the second partial quantity in the tundish is reached, and thereafter the supply of metal melt takes place at a filling rate which is reduced compared to this maximum inflow rate until the point at which the operating bath level of the second partial quantity in the tundish is reached.

Metal melt from the first partial quantity to the second partial quantity, i.e. from one region of the tundish into the other part of the tundish, is transferred through one or more openings in the divider plate. Metal melt from the first partial quantity to the second partial quantity may preferably be transferred through a free space between the divider plate and the base of the tundish. In this case, the divider plate does not continue all the way to the base of the tundish.

However, it is also possible for the divider plate to be formed as a securely anchored component of the tundish and to provide at least one permanent flow passage in the vicinity of the base of the tundish, which during all operating phases is completely below the bath surface of the metal melt.

The quasi-steady-state casting process begins at the point at which the quasi-steady operating bath level of the second partial quantity of the metal melt in the second region of the tundish is reached. When this quasi-steady operating bath level of the second partial quantity of the metal melt in the tundish is reached, the supply of metal melt into the tundish is controlled quantitatively as a function of the discharge of the metal melt from the tundish. This control is based on measuring the current bath level or the current tundish weight.

Further advantages and features of the present invention will emerge from the following description of non-restricting exemplary embodiments, in which reference is made to the accompanying figures, in which:

DESCRIPTION OF A PREFERRED EMBODIMENT

Figure 1:
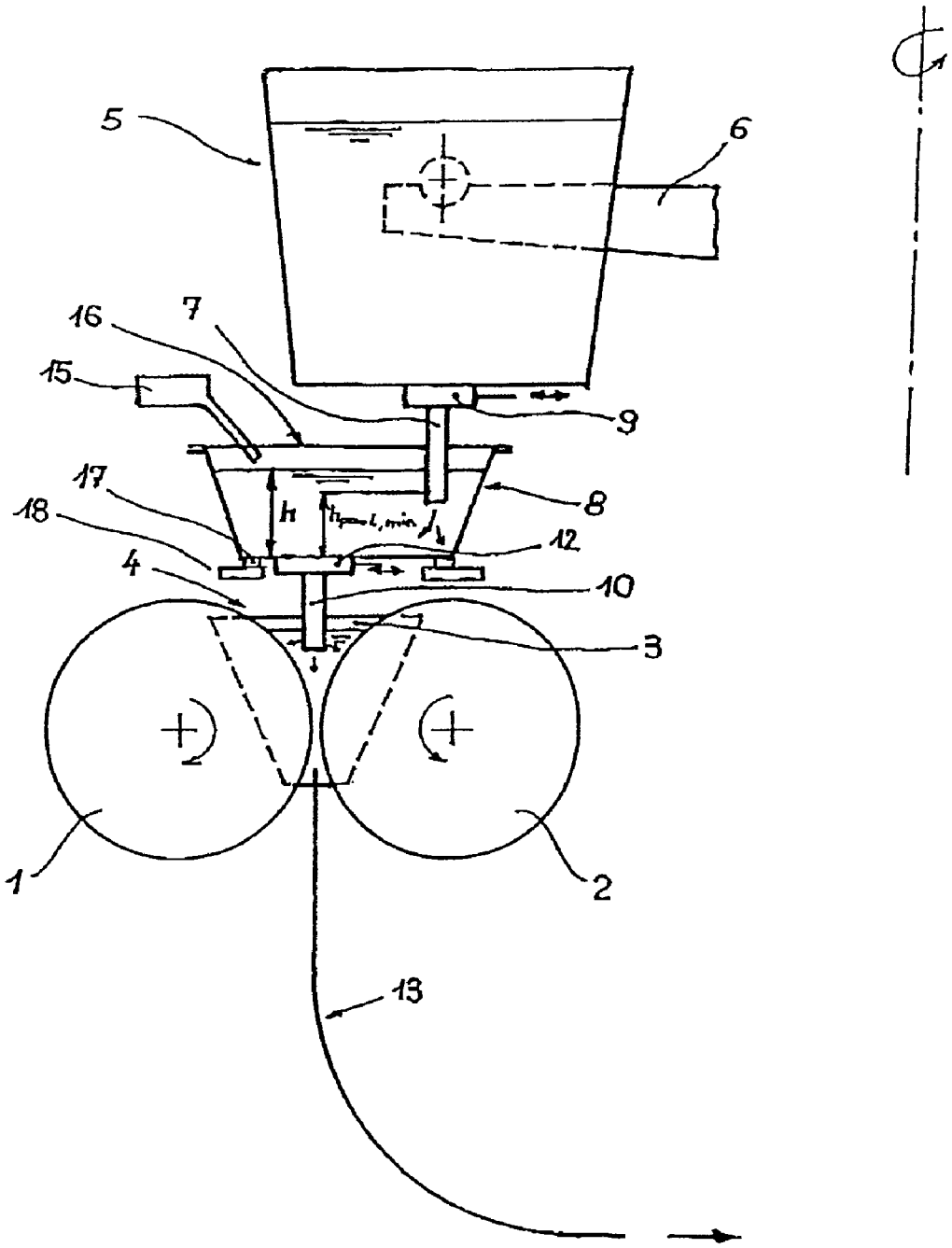
FIG. 1 diagrammatically depicts a two-roller casting installation having a melt vessel and a tundish for carrying out the process according to the invention.

FIG. 1 diagrammatically depicts a two-roller casting machine as one way of carrying out the process according to the invention, including the main structural components used to supply the metal melt into the continuous-casting mold 4, which is formed by two casting rollers 1, 2 rotating in opposite directions and sideplates 3 which can be pressed on to the end sides of the casting rollers. The metal melt is transferred from a melt vessel 5, which is generally formed by an exchangeable casting ladle supported on fork arms 6 of a ladle turning tower, through a shroud 7 into a tundish 8. The shroud 7 is assigned a slide closure 9 as a member for controlling the quantitative flow or filling rate. The metal melt flows out of the tundish 8 through a submerged casting nozzle 10 into the mold cavity 11 of the continuous-casting mold 4 in a quantitatively controlled manner. The submerged casting nozzle 10 is likewise assigned a slide closure 12 for controlling the quantity of melt which is to be supplied to the continuous-casting mold 4. The closure members may also be formed by plugs which, projecting through the melt bath from above, controllably close off the outflow opening of the respective melt vessel.

The quantity of metal melt which is temporarily held in the tundish 8 is kept as constant as possible during the continuous casting operation. This is achieved by setting a predetermined casting level h of the metal melt in the tundish and keeping this casting level as constant as possible by controlling the inflow quantity. A substantially uniform casting level ensures a uniform transfer of melt into the continuous-casting mold 4.

Strand shells (not shown) are formed in the melt pool at the cooled cylinder lateral surfaces of the casting rollers 1, 2, and at the narrowest cross section between the casting rollers these strand shells are rolled to form a metal strand 13 of predetermined thickness and width.

After the emptying of the melt vessel 5, in which context the slag covering the metal melt in the melt vessel as far as possible should not flow out, the empty melt vessel is removed from the casting installation and a prepared, filled melt vessel containing metal melt that has been prepared for casting is then moved into the casting position in the casting installation. During the time of about 2 min which this takes, the casting operation in the continuous-casting mold is continued using the quantity of residual melt present in the tundish, with the operating bath level dropping to a minimum bath level $h_{pool,min}$, at which, however, the shroud is still immersed in the melt bath. As a result, on resumption of the supply of melt into the tundish, the metal melt is prevented from directly striking the slag layer covering the metal bath, and therefore intensive mixing of the slag layer with the metal melt is avoided.

Figure 2:
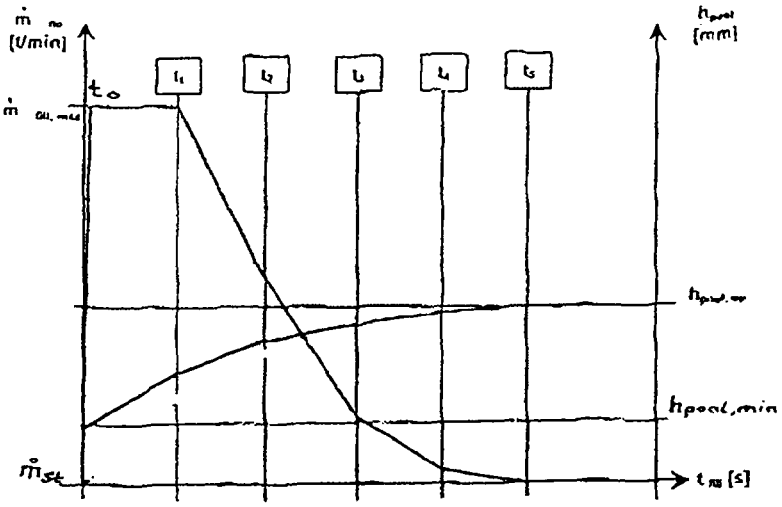
FIG. 2 shows the profile of a run-up curve for the refilling of the tundish (filling rate) according to a first embodiment of the process according to the invention.

According to one possible variant embodiment, the tundish filling operation takes place in accordance with the filling curve profile illustrated in FIG. 2. In the tundish there is a residual quantity of steel which corresponds to a bath level $h_{pool,min}$. During a first filling phase (period $t_0$-$t_1$), the metal melt is passed into the tundish with the slide closure opened to its maximum possible extent, i.e. the metal melt enters the tundish at the maximum filling rate $\dot{m}_{fill,max}$. Once a bath level $h_{pool}$ has been reached at time $t_1$, the filling rate is substantially continuously reduced until the quasi-steady operating bath level $h_{pool,op}$ has been reached, in which context the inflow rate into the tundish is less than double the outflow rate out of the tundish for 70% to 95% of the period from resumption of the supply of the metal melt into the tundish until the point at which the quasi-steady operating bath level $h_{pool,op}$ is reached. At time $t_5$, the steady filling rate $\dot{m}_{st}$ which is characteristic of steady-state casting operation is reached.

Figure 3:
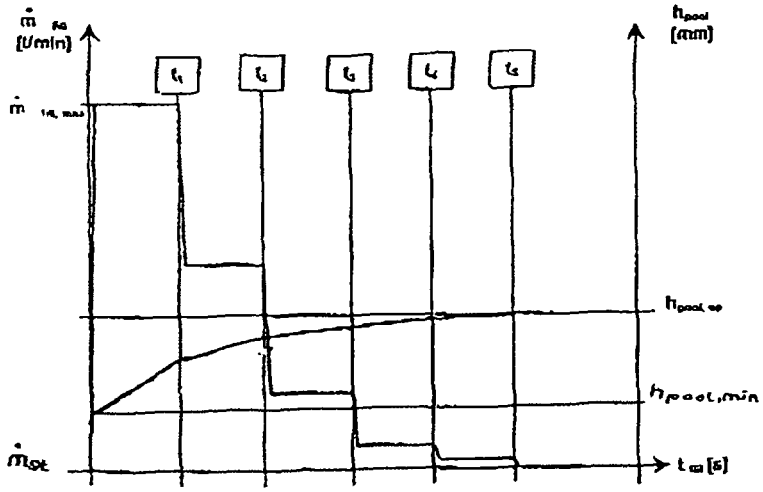
FIG. 3 shows the profile of a run-up curve for the refilling of the tundish (filling rate) according to a second embodiment of the process according to the invention.

FIG. 3 shows another variant embodiment of a possible filling curve profile, in which in a first filling phase (period $t_0$-$t_1$) the metal melt is introduced at the maximum filling rate $\dot{m}_{fill,max}$ or approximately the maximum filling rate (more than 80% of the maximum filling rate), and once time $t_1$ has been reached the filling rate is reduced in a plurality of steps, the reduction of the filling rate taking place at the individual times $t_1$ to $t_5$ in such a way as to effect a degressive approach of the bath level $h_{pool}$ to the operating bath level $h_{pool,op}$. At time $t_5$, the steady filling rate $\dot{m}_{st}$ which is characteristic of the steady-state casting operation is reached again.

Figure 4:
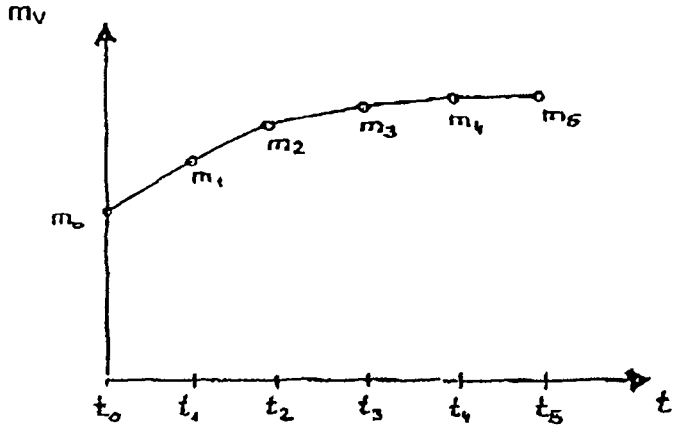
FIG. 4 shows the time profile of the tundish weight during the refilling of the tundish.

FIG. 4 shows the increase in the tundish weight $m_v$ over the filling time, starting from a tundish weight $m_0$, which corresponds to the empty weight of the tundish and the weight of the residual quantity of melt which remains in the tundish, until tundish weight $m_5$, which is achieved at the point at which the quasi-steady operating bath level $h_{pool,op}$ is reached.

These filling curve profiles illustrated in FIGS. 2 and 3 promote decay of the powerful bath movement in the tundish as early as during the continuous filling operation, and in particular calm the metal bath surface.

This calming phase in the tundish can be additionally boosted by the supply of melt being briefly interrupted after the point at which the quasi-steady operating bath level is reached. During this interruption period or at any subsequent desired time, if necessary additional covering agent can be added onto the metal bath surface using a semi-automatic or fully automatic addition device 15 (FIG. 1), the outlet opening of which opens out above the bath level into one or more regions of the tundish where surface turbulence is limited. The covering agent, which is in fine-grained to dust form, is applied to the metal melt in a continuous trickling operation and is intended to ensure complete coverage of the metal bath in the tundish.

In addition, the tundish 8 is covered with a tundish lid 16, which shields the interior of the tundish from the atmosphere. This also provides the option of inerting the interior even before metal melt is supplied, in particular during initial filling of the tundish.

When the quasi-steady operating bath level is reached, the continuous casting operation begins to be reintroduced. In this context, the quantity of the metal melt supplied to the tundish is set or controlled as a function of the quantity of melt introduced from the tundish into the continuous-casting mold. Deviations in the bath level from the desired quasi-steady operating bath level are recorded by means of a tundish weight measurement. As a result, a measurement variable which is characteristic of the bath level is determined continuously and used as setting or control variable in an inflow control circuit for controlling the quantity of metal melt which flows in. For this purpose, the tundish 8 is supported via measurement cells 17 on a carrying frame 18, for example a traveling tundish car (FIG. 1).

Figure 5A:
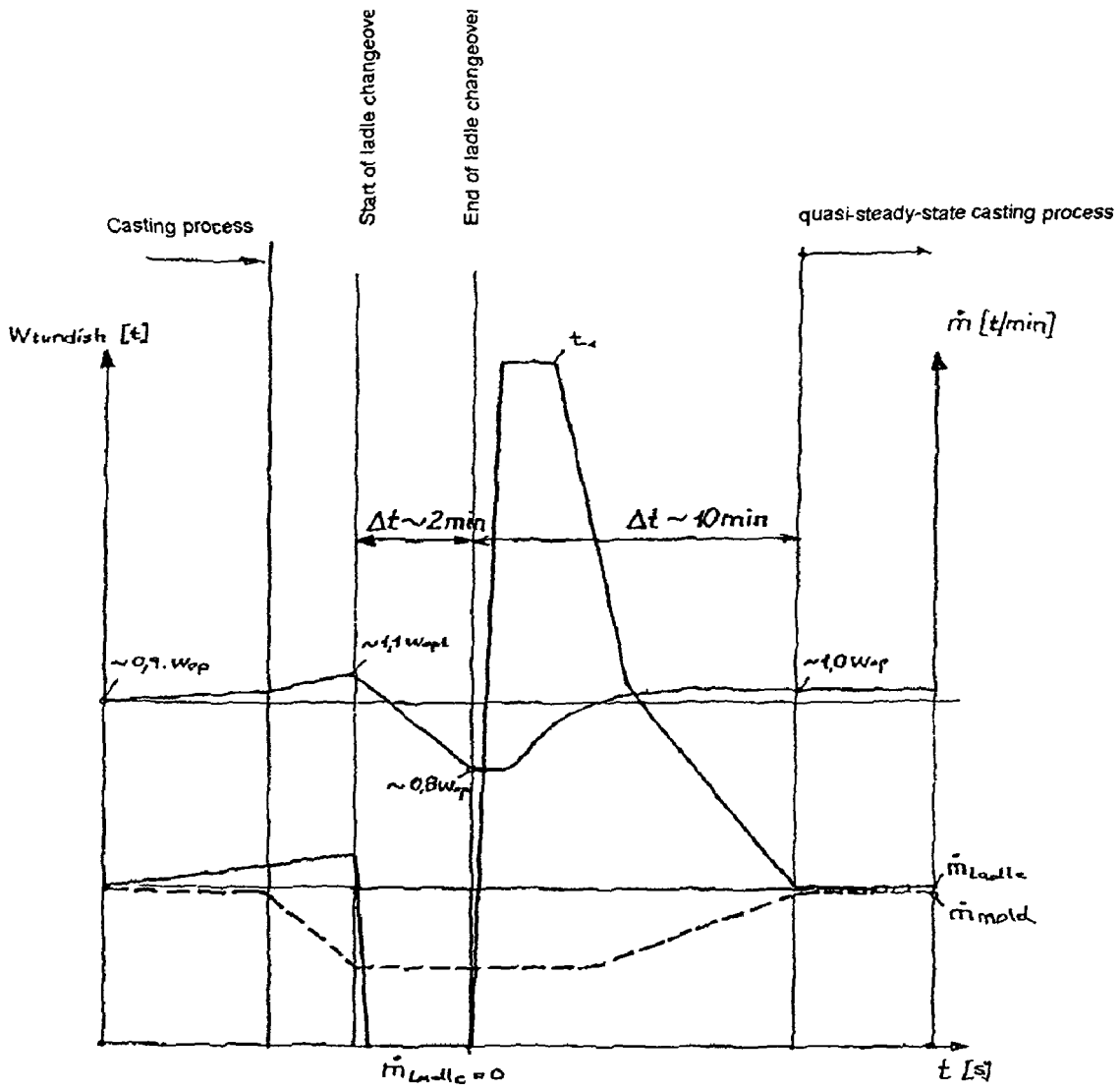
FIG. 5*a* shows the profile of relevant process characteristic variables during the change of a melt vessel according to a third embodiment of the invention.

FIG. 5*a* illustrates the sequence casting process according to the invention based on the example of a steel strip casting installation, the figure plotting the profile of characteristic variables, such as the tundish weight $w_{tundish}$, the filling rate in the tundish $\dot{m}_{ladle}$ and the filling rate in the permanent mold $\dot{m}_{mold}$ against the time axis, including a preceding period of time, starting before the change of a melt vessel is carried out, and with a subsequent period of time, after resumption of the steady-state casting operation. Even before the vessel change begins, measures are initiated to facilitate spanning the changeover time of approximately 2 min, by increasing the quantity of melt available in the tundish. This is achieved by increasing the filling rate $\dot{m}_{ladle}$ by opening the side closure at the melt ladle further, with the result that more metal melt flows into the tundish than is simultaneously flowing out into the continuous-casting mold. As a result, the tundish weight rises to approximately 1.1 times the tundish weight during steady-state casting operation. During the ladle change, which takes place immediately afterwards, the filling rate in the tundish is: $\dot{m}_{ladle}=0$. In parallel, the casting rate in the strip-casting machine is reduced and if appropriate, the casting level in the permanent mold is lowered, so that the casting operation in the continuous-casting mold is maintained with a reduced filling rate $\dot{m}_{mold}$. As soon as the melt vessel changeover has ended, the quasi-steady operating state in the tundish is restored over a period of approximately 10 min by metal melt being introduced into the tundish at the maximum or approximately the maximum filling rate until a time $t_1$ and thereafter running up to the quasi-steady operating bath level based on a degressive curve profile. The casting level in the tundish, which is determined indirectly by a weight measurement follows the curve profile $w_{tundish}$ and prior to the vessel changeover shows the desired increase with a view to increasing the level in the tundish, and thereafter reveals the drop to a level of approximately 80% of the tundish weight or operating bath level by the time the ladle changeover has ended.

Figure 5B:
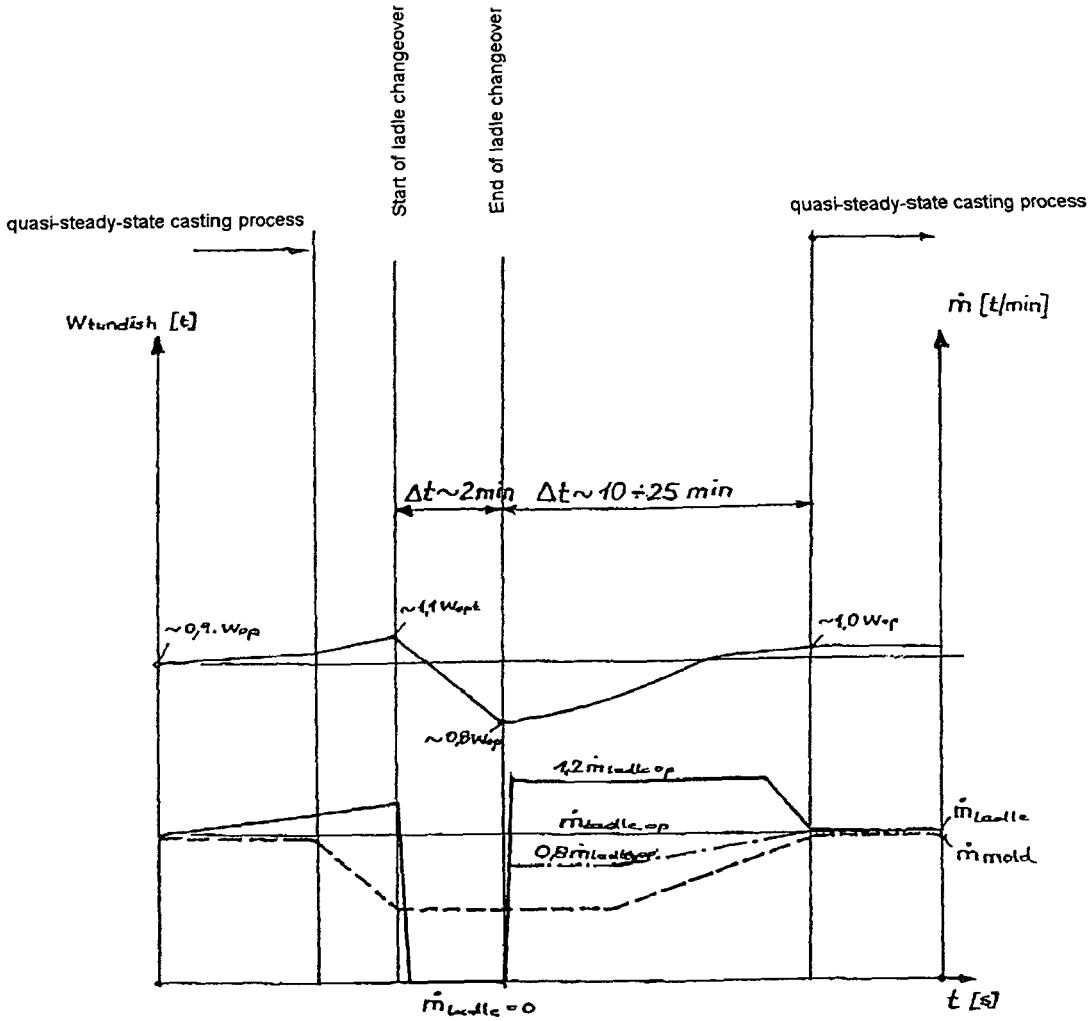
FIG. 5*b* shows the profile of relevant process characteristic variables during the change of a melt vessel according to a fourth embodiment of the invention.

According to a further embodiment, which is illustrated in FIG. 5*b*, the resumption of the supply of melt into the tundish takes place at a significantly reduced filling rate $\dot{m}_{ladle,start}$ which corresponds to 0.8 to 1.2 times the filling rate $\dot{m}_{ladle,opt}$ during steady-state casting operation. This reduced filling rate may expediently be within a range from 0.5 to 2 times the filling rate $\dot{m}_{ladle,opt}$. The filling rate is kept approximately constant over a wide range of the period until the tundish has been refilled. The fundamental advantage of this variant lies in the significantly lower rate at which the metal melt flows into the tundish, resulting in substantially reduced surface turbulence at the metal bath. The flow rate remains low enough to ensure a good rate of separation of the nonmetallic inclusions into the slag layer and to avoid the reintroduction of slag. However, on the other hand, the time needed to refill the tundish increases to up to 25 min, with a simultaneously reduced filling rate in the permanent mold. An expedient filling rate profile which lies between the embodiments illustrated in FIGS. 5*a* and 5*b* can be selected according to the steel grade to be cast and product requirements.

Figure 6:
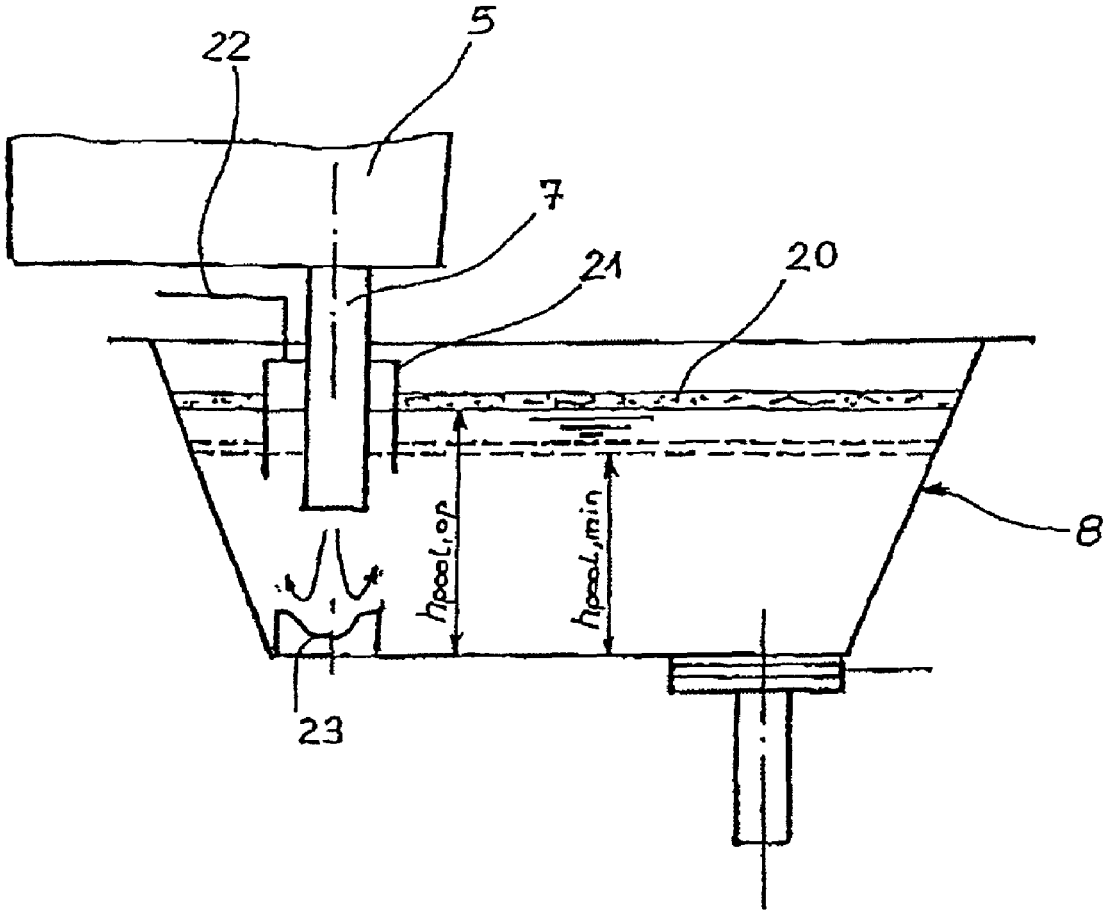
FIG. 6 shows a shroud which is shielded from contact with slag.

FIG. 6 shows a way of substantially preventing the introduction of covering agent which has been applied to the melt bath into the interior of the melt bath along or near to the outer wall of the shroud. Metal melt flows continuously out of the melt vessel 5 to the metal melt which has already accumulated in the tundish 8 through the shroud 7 which is vertically immersed in the melt. The metal melt flowing in generates a sucking action along the shroud and any slag/covering agent which is collected in this region is drawn down into the metal melt. A cover 21 which is designed in the form of a pot, surrounds the shroud at a radial distance therefrom and projects into the metal melt from above, keeps the layer of slag 20 which has formed away from the critical region in the vicinity of the shroud. The interior of this cover can, if required, be inerted via the shielding gas line 22. It is expedient for this cover to extend sufficiently far into the melt bath for it to be ensured that the shroud is immersed even at the minimum bath level $h_{min}$. To continuously maintain the function of the cover 21, it is essential for the bath level during the melt vessel changeover not to drop below the value $h_{min}$, i.e. it is imperative that the lower edge of the cover 21 should always be immersed in the melt bath.

As seen in the outflow direction of the metal melt, a flow-damping element 23 (Turbostop) is fixedly anchored in the tundish opposite the shroud 7, thereby greatly decelerating the jet of liquid metal flowing into the tundish.

The sequence casting process described has been found to be particularly successful in conjunction with a tundish which has been described in WO 03/051560 and has a geometry that particularly promotes the separation of particles that are foreign to the melt.

Figure 7A:
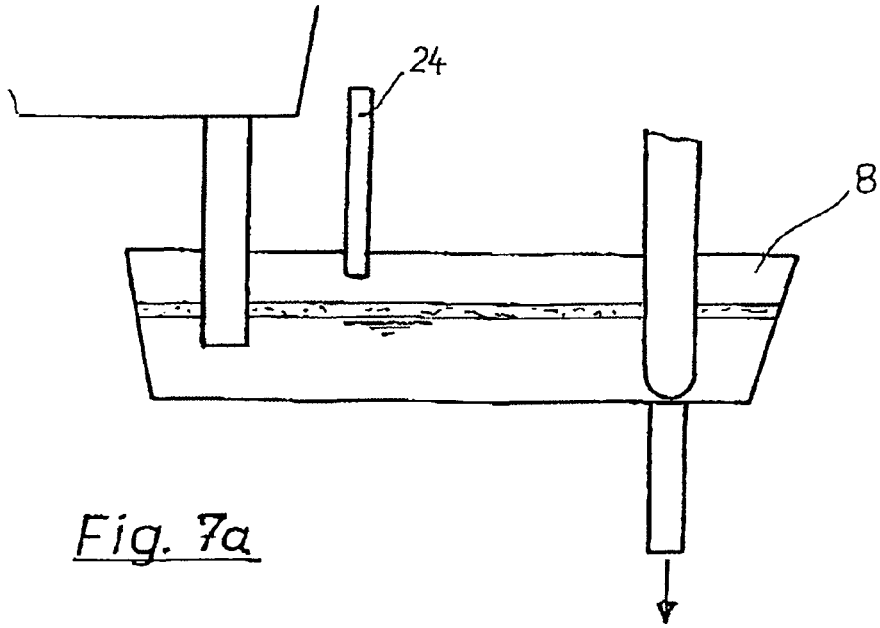
FIG. 7*a* shows a tundish with a divider plate in a first, lifted-out operating position.
Figure 7B:
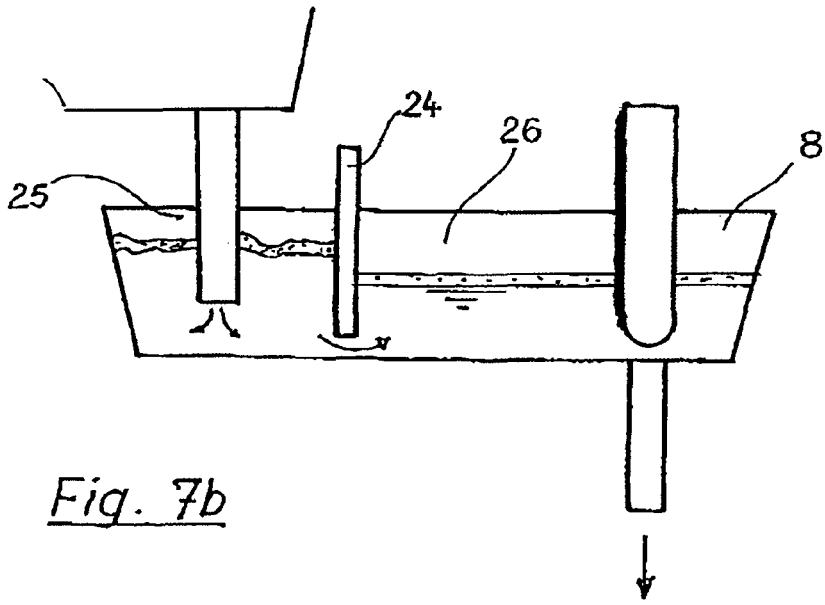
FIG. 7*b* shows a tundish with a divider plate in a second, moved-in operating position.

FIGS. 7*a* and 7*b* illustrate a vertically movable divider plate 24 in two operating positions in conjunction with the tundish 8. This embodiment is intended to achieve a functional separation in the tundish. FIG. 7*a* shows the operating state in the tundish immediately before resuming casting of a new melt vessel. The metal melt which is still present in the tundish is covered with a covering agent and flows out at a rate corresponding to the reduced casting rate. The divider plate is still in a raised position and is lowered into the tundish in order to divide it into two regions, as illustrated in FIG. 7*b*. The moved-in divider plate prevents or at least greatly reduces disadvantageous effects on the entire quantity of melt in the tundish during the initial filling phase, which takes place at the maximum or approximately the maximum filling rate. A first region 25 is assigned to the supply of melt, while a second region 26 is assigned to the discharge of the melt into the continuous casting mold. In the first region 25, the melt bath is significantly calmed and a large proportion of the particles foreign to the melt are separated out at the slag layer in the first region. In the second region 26, residual levels of foreign particles which are still present in the metal melt are separated out into the slag layer covering the metal bath.

The invention claimed is:

1. A sequence casting process for continuous production of a high-purity cast metal strand from a metal melt, the process comprising:

feeding the metal melt from a melt vessel to a tundish; and discharging the metal melt from the tundish into a continuous-casting mold, the feeding of the metal melt into the tundish being interrupted during a change of melt vessel while the discharging of the metal melt into the continuous-casting mold is continued, wherein during a first period of time starting from a resumption of the feeding of the metal melt into the tundish until a point at which a quasi-steady-state operation bath level in the tundish is reached, an inflow rate into the tundish is greater than an outflow rate out of the tundish, and such that for 70% to 100% of the first period of time the inflow rate into the tundish is less than or equal to double the outflow rate out of the tundish, wherein the feeding of the metal melt into the tundish within the last 5% to 30% of the first period of time is continued and is performed at a reduced inflow rate compared with the inflow rate during a preceding time period of the first period of time such that by an end of the last 5% to 30% of the first period of time an unchanging filling rate of the tundish equal to a rate of the discharging of the metal melt from the tundish is attained.

2. The sequence casting process as claimed in claim 1, wherein the inflow rate into the tundish corresponds to at least 0.5 times a maximum inflow rate during quasi-steady-state casting operation.

3. The sequence casting process as claimed in claim 1, wherein the feeding of the metal melt takes place at an initial filling rate that is a maximum inflow rate immediately on the resumption of the feeding of the metal melt into the tundish for 0.1% to 30% of the first period of time, and thereafter the feeding of the metal melt takes place at a filling rate which is reduced compared to the initial filling rate until an end of the first period of time.

4. The sequence casting process as claimed in claim 1, wherein the reduced inflow rate follows a time curve which decreases continuously.

5. The sequence casting process as claimed in claim 1, wherein the feeding of the metal melt into the tundish is interrupted for a second period of time during which the quasi-steady-state operation bath level is reached.

6. The sequence casting process as claimed in claim 5, wherein the second period of time lasts between 1 second and 2 minutes.

7. The sequence casting process as claimed in claim 1, wherein a region of a free bath surface in the tundish immediately surrounding a shroud is kept free of coverage with a covering agent at least during quasi-steady-state operation.

8. The sequence casting process as claimed in claim 5, wherein after the resumption of the feeding of the metal melt into the tundish, the feeding of the metal melt into the tundish is controlled quantitatively as a function of the discharge of the metal melt from the tundish.

9. The sequence casting process as claimed in claim 1, wherein the feeding of the metal melt into the tundish is controlled quantitatively as a function of the discharge of the metal melt from the tundish at least for 70% to 100% of the first period of time or from the point at which the quasi-steady-state operation bath level is reached.

10. The sequence casting process as claimed in claim 1, wherein a quantity of the metal melt fed to the tundish and a quantity of the metal melt discharged from the tundish during casting of a steel strip on a two-roller casting installation is between 0.5 t/minutes and 4.0 t/minutes.

11. The sequence casting process as claimed in claim 1, further comprising adding a covering agent onto a bath surface of the metal melt in the tundish on demand in a surface region with a low surface flow velocity, waviness of the bath surface or turbulence intensity.

12. The sequence casting process as claimed in claim 11, wherein the covering agent is added in fine-grain or powder form using a semi-automatic or a fully automatic addition device.

13. The sequence casting process as claimed in claim 1, further comprising setting and monitoring the quasi-steady-state operation bath level by means of a tundish weight measurement or by means of an equivalent measurement method.

14. The sequence casting process as claimed in claim 1, further comprising dividing by a divider plate at least during the first period of time the metal melt contained in the tundish into a first partial quantity and a second partial quantity, the metal melt from the melt vessel being fed to the first partial quantity and the metal melt being discharged from the tundish from the second partial quantity into the continuous-casting mold, and the metal melt being transferred continuously from the first partial quantity to the second partial quantity, wherein the inflow rate to the first partial quantity in the tundish is greater than the outflow rate from the second partial quantity, and the inflow rate to the first partial quantity is less than or equal to double the outflow rate from the second partial quantity for 70% to 100% of the first period of time.

15. The sequence casting process as claimed in claim 14, wherein the metal melt is fed into the first partial quantity of the tundish at a maximum inflow rate immediately on the resumption of the feeding of the metal melt into the tundish for 1% to 30% of the first period of time, and thereafter the metal melt is fed at a filling rate reduced compared to the maximum inflow rate until a point at which the quasi-steady-state operation bath level of the second partial quantity in the tundish is reached.

16. The sequence casting process as claimed in claim 14, further comprising transferring the metal melt from the first partial quantity to the second partial quantity through one or more openings in the divider plate.

17. The sequence casting process as claimed in claim 14, wherein the metal melt is transferred through a free space between the divider plate and a base of the tundish.

18. The sequence casting process as claimed in claim 14, wherein when a quasi-steady-state operation bath level of the second partial quantity of the metal melt in the tundish is reached, the feeding of the metal melt into the tundish is controlled quantitatively as a function of the discharge of the metal melt from the tundish.

19. The sequence casting process as claimed in claim 1, wherein the metal melt is a steel melt.

20. The sequence casting process as claimed in claim 1, wherein for 70% to 99% of the first period of time the inflow rate into the tundish is less than or equal to double the outflow rate out of the tundish.

21. The sequence casting process as claimed in claim 1, wherein for 70% to 95% of the first period of time the inflow rate into the tundish is less than or equal to double the outflow rate out of the tundish.

22. The sequence casting process as claimed in claim 21, wherein the inflow rate into the tundish is less than or equal to 1.5 times the outflow rate out of the tundish.

23. The sequence casting process as claimed in claim 1, wherein the feeding of the metal melt takes place at an initial filling rate that is a maximum inflow rate immediately on the resumption of the feeding of the metal melt into the tundish for 3% to 15% of the first period of time, and thereafter the feeding of the metal melt takes place at a filling rate which is reduced compared to the initial filling rate, until an end of the first period of time.

24. The sequence casting process as claimed in claim 5, wherein the second period of time lasts between 10 seconds and 70 seconds.

25. The sequence casting process as claimed in claim 14, wherein the inflow rate to the first partial quantity is less than or equal to double the outflow rate from the second partial quantity for 70% to 95% of the first period of time.

* * * * *